United States Patent [19]

Balderson

[11] Patent Number: 4,827,108

[45] Date of Patent: May 2, 1989

[54] SUBSTRATES FOR SUPPORTING ELECTRICAL TRACKS AND/OR COMPONENTS

[75] Inventor: Simon Balderson, Reading, England

[73] Assignee: Thorn EMI plc, London, England

[21] Appl. No.: 159,674

[22] Filed: Feb. 24, 1988

[30] Foreign Application Priority Data

Feb. 25, 1987 [GB] United Kingdom ..... 8704468

[51] Int. Cl.[4] ..... H05B 3/16

[52] U.S. Cl. ..... 219/543; 29/612

[58] Field of Search ..... 219/543, 443, 445, 538, 219/544, 546, 548, 552, 553; 338/306–308; 29/612

[56] References Cited

U.S. PATENT DOCUMENTS

| | | | |
|---|---|---|---|
| 3,647,532 | 3/1972 | Friedman et al. | 252/512 X |
| 3,872,415 | 3/1975 | Groves et al. | 338/35 X |
| 4,469,936 | 9/1984 | Hunter | 219/537 X |
| 4,612,433 | 9/1986 | Nagaoka et al. | 219/216 PH |

FOREIGN PATENT DOCUMENTS

| | | |
|---|---|---|
| 990023 | 4/1965 | United Kingdom . |
| 1463317 | 2/1977 | United Kingdom . |

*Primary Examiner*—C. L. Albritton

*Attorney, Agent, or Firm*—Fleit, Jacobson, Cohn & Price

[57] ABSTRACT

A substrate for supporting electrical components, such as thick film resistive heating elements, comprises a plate member, such as a metallic plate member, coated on one or both of its flat surfaces with a glass ceramic material.

It has been found that the problems of (a) electrical breakdown between the metallic plate member and the thick film resistive heating element and (b) lack of adhesion between the thick film and the glass ceramic material can be substantially reduced or eliminated by reducing the porosity of the glass ceramic material. Methods of producing a glass ceramic layer having a low porosity, involving a two-stage heating process, are described.

10 Claims, 2 Drawing Sheets

SUBSTRATES FOR SUPPORTING ELECTRICAL TRACKS AND/OR COMPONENTS

This invention relates to substrates intended to support electrical components, for example thick film resistive heating elements, and it relates especially, though not exclusively, to such substrates which comprise a metallic plate member coated on one or both of its flat surfaces with a glass ceramic material. The invention also provides a method of manufacturing such substrates.

Such substrates are known, one being available under the trade name KERALLOY from Wade Potteries plc, and have been proposed for use in supporting resistive heating elements applied, for example, as thick films by screen printing, and intended for domestic usage, for example as hob heating elements.

GB No. 990023 (Associated Electrical Industries Limited), for example, discloses a printed electrical heater assembly comprising a metal backing member, a heat resistant electrically insulating coating formed of e.g. a ceramic on at least one surface of said metal and a conductive coating formed on said insulating layer or layers of a material having a suitable conductivity and pattern to form an electrical heater circuit or circuits. The metal backing member having a heat resistant electrically insulating coating on at least one surface provides the substrate for the conductive coating.

Difficulties arise in practice, however, with the use of such substrates under the exacting operational conditions associated with hob units. In particular, it has been found that electrical breakdown can occur between the thick film resistive heater and the metallic plate member included in the substrate, which is generally held at earth potential, when mains voltage is applied to the track. Furthermore, the thick film resistive heater track can exhibit lack of adhesion to the glass ceramic material.

It has been determined by the inventor that both the above-identified difficulties can be substantially reduced or eliminated by ensuring that the percentage porosity of the glass ceramic coating material, as defined hereinafter, is rendered less than or equal to 2.5 and the invention provides a substrate having a glass ceramic coating of such low porosity and a method of producing such a substrate.

According to the present invention, there is provided a substrate for supporting electrical components, said substrate comprising a plate member having on at least one surface a layer of a glass ceramic material wherein the percentage porosity of the glass ceramic layer, as defined hereinafter, is equal to or less than 2.5.

By percentage porosity is meant the porosity at a random cross-sectional plane through the substrate perpendicular to the plate member expressed as the percentage ratio of the cross-sectional area of pores on the plane to the cross-sectional area of the remainder of the glass ceramic layer on that plane.

In order that the invention may be clearly understood and readily carried into effect, embodiments thereof will now be described, by way of example only, with reference to the accompanying drawings of which:

Figure 1:
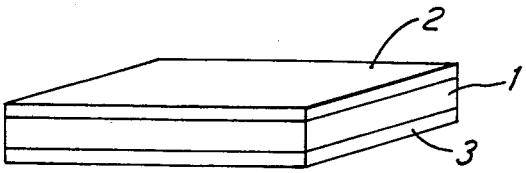
FIG. 1 shows, in perspective view, a substrate in accordance with one example of the invention.

Referring now to FIG. 1, there is shown a substrate including a support plate 1, made of e.g. metal or a glass ceramic material of suitable thickness to provide rigidity, coated on either side with a glass ceramic material 2,3, such as a calcium magnesium alumina silicate. The glass ceramic coatings 2,3 are applied by screen printing powdered glass ceramic material on to the support plate, or by electrophoresis. It is a characteristic of glass-ceramic materials that they can be caused to crystallise by the application of heat, and it is usual in this field for the powdered coatings of amorphous glass to be caused to crystallise, thus converting them into continuous glass ceramic layers, by heating the entire substrate, in a single-stage process, up to a temperature in excess of 1000° C., above the material's softening point, at which it crystallises rapidly. The material is then allowed to cool.

Figure 2:
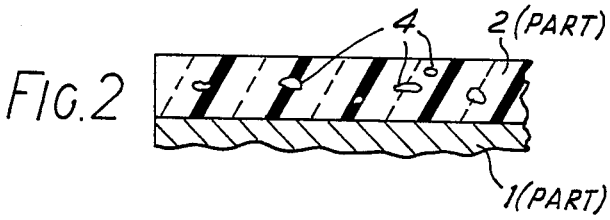
FIG. 2 shows a cross-sectional view, on a magnified scale, of the substrate shown in FIG. 1, and illustrates how the degree of porosity of the glass ceramic layer is specified.

Substrates prepared in this way, however, tend to exhibit an undesirably high degree of porosity, the percentage porosity value being determined e.g. as shown in FIG. 2 by making a random cross-sectional cut through the substrate perpendicular to the plane of the support plate. The ratio of the area of all pores such as 4 sliced through by the cut to that of the remainder of the glass ceramic layer in the plane of the cut is called the porosity ratio and is conveniently expressed as a percentage (P). It is a characteristic of this invention that the value of P is equal to or less than 2.5. This compares with values of P of 4.0 or more achievable by more conventional processing.

The desirably low values of P required by the invention are achievable, the inventor has determined, by observing that the powdered glass ceramic coating can be converted into a continuous layer by means of a two-stage heating process, in the first stage of which the substrate is heated, not to the aforementioned temperature in excess of 1000° C., at which crystallisation occurs rapidly, but rather to a temperature above the softening temperature of the glass ceramic material, but below the temperature at which rapid crystallisation occurs, e.g. in the range of from 800° C. to 890° C., preferably in the range of from 800° C. to 875° C. for the aforementioned calcium magnesium alumina silicate, at which the material has softened appreciably but crystallises only slowly, for a time dependent upon the temperature concerned, but typically of the order of five to thirty minutes. This time is dependent upon the rate of crystallisation and the viscosity of the material in its softened state. At the lower end of this range, the viscosity of the coating material is high, but crystallisation is slow and an extended time may be allowed for pores to close. At the upper end of the range, the viscosity of the coating is markedly reduced, and, although, crystallisation is relatively rapid, the majority of pores are found to close before an appreciably crystalline layer is formed. For the aforementioned calcium magnesium alumina silicate, in the first stage of the process the material is preferably heated at 875° C. for 7 minutes. The mechanism of pore closure is believed to be primarily that of surface tension.

The second stage of the process, which involves the rendering permanent of the glass ceramic state by heat treatment, similar to that conventionally used, and as mentioned above, is to raise the coating temperature to a value (e.g. in excess of 1000° C. for the aforementioned calcium magnesium alumina silicate) at which rapid crystallisation occurs, but below that at which the crystals redissolve, the rapid crystallisation producing a glass ceramic layer. The end result is the production of a substrate in which the glass ceramic layers exhibit percentage porosities of 2.5 or less. This is found to reduce considerably the incidence of failure of heater units by electrical breakdown and also improves adhesion of the thick film resistive heater track to the glass ceramic material.

In another method the substrate is produced by the application of a plurality of glass ceramic layers to the support plate, each individual layer being produced by the two-stage heating process. The inventor has found that the electrical breakdown characteristics of the substrate depend markedly on and are improved by the number of glass ceramic layers used, even if the overall thickness of the composite is the same. The reason for this appears to be that pinholes may be produced during the formation of a layer which are too large to be completely closed during the first stage of the two stage heating process, but that there is a very small chance that pinholes in successive layers will coincide to provide a complete path from the electrical component to the metallic support plate.

It is also possible to produce the substrate by applying a plurality of glass ceramic layers, each individual layer being treated using the first stage of the heating process before the next layer is applied. The composite layer may then be rendered permanent using the second stage of the two-stage heating process. Substrates produced using this method do exhibit some improvement in their electrical characteristics.

The use of screen printing to apply glass ceramic coatings to produce the substrate is particularly applicable to the methods as described in accordance with the present invention. To provide a glass ceramic layer of suitable thickness, e.g. 100 μm, four coatings of glass ceramic material are printed onto the support plate, the whole then being fired using the two-stage heating process. Alternatively, the two-stage heating firing is used to produce a first glass ceramic layer after two coatings have been printed, following which a subsequent two coatings are printed and fired by the two-stage heating process. The resulting glass ceramic layer produced in this method is of the same thickness as that produced by the aforementioned method but has significantly improved electrical breakdown characteristics.

In another method using screen printing, two coatings are printed and then fired using the two-stage heating process. This is repeated a further two times to produce a glass ceramic layer of greater thickness e.g. 150 μm. The further significant improvement in electrical breakdown characteristics for the glass ceramic layer produced by this method is believed to be caused by the combination of multiple firings and the greater thickness of the glass ceramic layer.

In producing substrates using screen printing, it has been found that, provided that the composite glass ceramic layer on the substrate is of suitable thickness, two is the optimum number of coatings to be printed and then fired at the same time using the two-stage heating process. The advantage of this may be in the production of a glass ceramic layer of sufficient thickness whose state, including the position of any pinholes, has been rendered permanent, before the next layer is applied. It is possible that, if an individual glass ceramic layer, applied and fired using the two-stage heating process, is not of sufficient thickness, the benefit of using multiple firings is lessened.

Figure 3A:
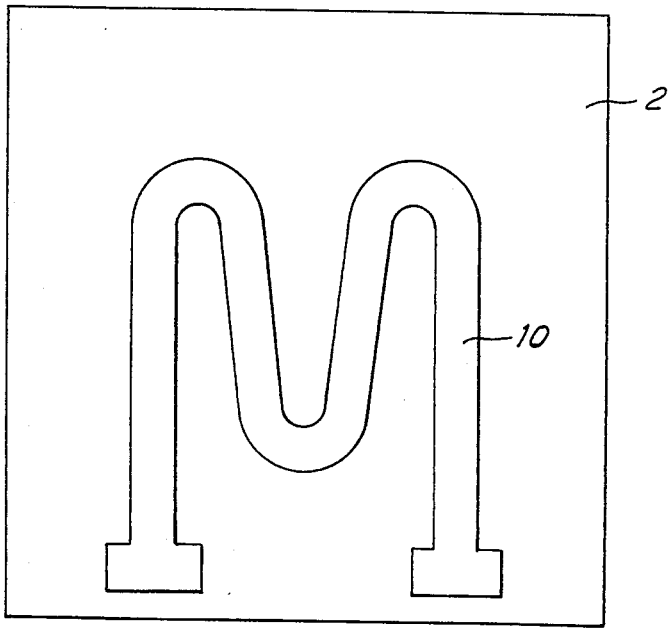
FIGS. 3*a* and 3*b* show, in plan view, substrates of the kind shown in FIG. 1, bearing a resistive heating track suitable for use on a hob unit.
Figure 3B:
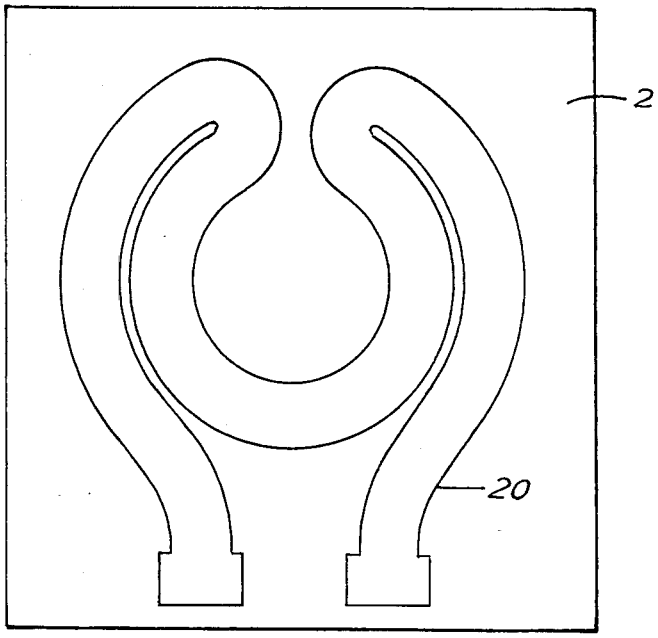

FIGS. 3*a* and 3*b* show typical thick film resistive heating tracks 10 and 20 printed in known manner on to the coated surface 2 of a substrate of the kind shown in FIG. 1. The track can be of precious metal or any other suitable material known to those in the art and the entire unit as shown in FIG. 3*a* or 3*b* is preferably overglazed with glass ceramic material.

In use, a unit such as that shown in FIG. 3*a* or 3*b*, or a larger substrate containing, say, four individually energisable heating tracks may be deployed either beneath a conventional glass ceramic hob top to provide the heater units of a domestic hob or cooker, or as a hob unit itself. Heater units so provided have low thermal mass, and correspondingly a thermal response which is considerably faster than that of conventional cooker elements and can approach that of the recently developed technology which utilises halogenated tungsten filament lamps as heat sources.

Clearly, the invention's use is not restricted to hobs and cookers. There are many domestic and industrial heating applications for which the invention would be suitable. Some non-limitative examples are kettle jugs, electric irons, space heaters, tumble dryers, and ovens.

It will be appreciated that the heater units need not be formed as, or retained in the form of, a flat plate and other substrate configurations, such as cylinders and cones, can be used for certain applications if desired. Air can be forced over and/or through a suitably shaped heater unit, if desired, to distribute heated air to locations other than the immediate vicinity of the heater unit itself.

The invention can also be used in low-power applications, where for example, resistive components desposited on a substrate need to be laser trimmed to a predetermined value of resistance. The low porosity exhibited by the glass ceramic on a substrate in accordance with the invention is beneficial because it reduces the incidence of uncontrolled rupture of a component being trimmed by a laser beam which can occur if the beam punctures a pore in the vicinity of the component. Such rupture usually causes the resistance value of the component to depart from tolerance and thus necessitates the scrapping, or at least reprocessing, of the unit.

I claim:

1. A substrate for supporting electrical components, said substrate comprising a plate member having on at least one surface a layer of a glass ceramic material wherein the percentage porosity of the glass ceramic layer, as defined hereinbefore, is equal to or less than 2.5.

2. A heater unit for a cooker comprising a substrate according to claim 1 and a thick film heater track printed on said substrate.

3. A method of making a substrate for supporting electrical components comprising the steps of:

(a) providing a plate member;

(b) applying a coating of a glass ceramic material to a surface of said plate member;

(c) heating said coating by a two-stage heating process comprising:

(i) a first stage of heating said coating to a first temperature above the softening temperature of said glass ceramic material and holding said coating at said first temperature for a predetermined time, said predetermined time being sufficient to allow pores in said coating to substantially close; and (ii) a second stage of heating said coating to a second temperature greater than said first temperature to crystallise said coating layer;

whereby said layer produced has a percentage porosity, as defined hereinbefore, equal to or less than 2.5.

4. A method according to claim 3 wherein said two-stage heating process is applied to a plurality of successively applied layers of glass ceramic material.

5. A method according to claim 3 wherein a respective said two-stage heating process is applied to each of a plurality of groups of successively applied layers of said glass ceramic material.

6. A method according to claim 5 wherein a respective said two-stage heating process is applied to each of two groups of successively applied layers of said glass ceramic material, each of said two groups consisting of two of said layers.

7. A method according to claim 5 wherein a respective said two-stage heating process is applied to each of three groups of successively applied layers of said glass ceramic material, each of said three groups consisting of two of said layers.

8. A method according to claim 3 wherein a respective first stage of said two-stage heating process is applied to each of a plurality of groups of successively applied layers of said glass ceramic material to produce a composite layer, said second stage of said two-stage heating process then being applied to said composite layer.

9. A method according to claim 3 wherein said glass ceramic material is a calcium magnesium alumina silicate and said first temperature is in the range of from 800° C. to 875° C.

10. A method according to claim 9 wherein said second temperature is in excess of 1000° C.

* * * * *